US006743118B1

(12) United States Patent
Soracco

(10) Patent No.: US 6,743,118 B1
(45) **Date of Patent: *Jun. 1, 2004**

(54) GOLF CLUB HEAD

(75) Inventor: Peter L. Soracco, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/065,779

(22) Filed: Nov. 18, 2002

(51) Int. Cl.[7] ..... A63B 53/04

(52) U.S. Cl. ..... 473/342; 473/345; 473/349; 473/324

(58) Field of Search ..... 473/324, 329, 473/330, 334, 335, 342, 345, 349, 350

(56) References Cited

U.S. PATENT DOCUMENTS

| | | | |
|---|---|---|---|
| 1,167,387 | A | 1/1916 | Daniel |
| 1,638,916 | A | 8/1927 | Butchart |
| 1,780,625 | A | 11/1930 | Mattern |
| 2,750,194 | A | 6/1956 | Clark |
| 3,692,306 | A | 9/1972 | Glover |
| 3,897,066 | A | 7/1975 | Belmont |
| 3,937,474 | A | 2/1976 | Jepson et al. |
| 3,970,236 | A | 7/1976 | Rogers |
| 3,975,023 | A | 8/1976 | Inamori |
| 3,989,248 | A | 11/1976 | Campau |
| 4,021,047 | A | 5/1977 | Mader |
| 4,398,965 | A | 8/1983 | Campau |
| 4,568,088 | A | 2/1986 | Kurahashi |
| 4,872,685 | A | 10/1989 | Sun |
| 4,877,249 | A | 10/1989 | Thompson |
| 5,024,437 | A | 6/1991 | Anderson |
| 5,094,383 | A | 3/1992 | Anderson |
| 5,106,094 | A | 4/1992 | Desboilles et al. |
| 5,163,682 | A | 11/1992 | Schmidt et al. |
| 5,193,811 | A | 3/1993 | Okumoto et al. |
| 5,255,918 | A | 10/1993 | Anderson |
| 5,261,663 | A | 11/1993 | Anderson |
| 5,261,664 | A | 11/1993 | Anderson |
| 5,282,624 | A | 2/1994 | Viste |
| 5,310,185 | A | 5/1994 | Viollez et al. |
| 5,318,300 | A | 6/1994 | Schmidt et al. |
| 5,344,140 | A | 9/1994 | Anderson et al. |
| 5,346,216 | A | 9/1994 | Aizawa |
| 5,377,986 | A | 1/1995 | Viollaz et al. |
| 5,398,935 | A | 3/1995 | Katayama |
| 5,410,798 | A | 5/1995 | Lo |
| 5,425,538 | A | 6/1995 | Vincent et al. |
| 5,464,210 | A | 11/1995 | Davis et al. |
| 5,474,296 | A | 12/1995 | Schmidt et al. |
| 5,499,814 | A | 3/1996 | Lu |
| 5,516,107 | A | 5/1996 | Okumoto et al. |
| 5,547,427 | A | 8/1996 | Rigal et al. |
| 5,570,886 | A | 11/1996 | Rigal et al. |
| 5,624,331 | A | 4/1997 | Lo et al. |
| 5,743,813 | A | 4/1998 | Chen et al. |
| 5,776,011 | A | 7/1998 | Su et al. |
| 5,830,084 | A | 11/1998 | Kosmatka |
| 5,863,261 | A | 1/1999 | Eggiman |
| 5,888,148 | A | 3/1999 | Allen |
| 6,010,411 | A | 1/2000 | Reyes |
| 6,048,278 | A | 4/2000 | Meyer et al. |

(List continued on next page.)

*Primary Examiner*—Glenn Caldarola
*Assistant Examiner*—Thanh Duong
(74) *Attorney, Agent, or Firm*—Michael A. Catania; Elaine H. Lo

(57) ABSTRACT

A golf club (40) having a club head (42) with a frame member (60) and a body (61) is disclosed herein. The front member (60) has a front portion (72) and a return portion (74). The body (61) has a crown portion (62), a sole portion (64), a front wall (87) and optionally a ribbon section (90). A transition from the front wall to the crown portion (62) has a radius of curvature of at least 0.250 inch. The softer radius of the transition allows for a more durable and better performing club head. The frame member (60) may also be weighted to move the center of gravity of the club head forward toward the front wall (87).

15 Claims, 8 Drawing Sheets

U.S. PATENT DOCUMENTS 6,146,571 A 11/2000 Vincent et al.
6,149,534 A 11/2000 Peters et al.
6,152,833 A 11/2000 Werner et al.
6,165,081 A 12/2000 Chou
6,354,962 B1 3/2002 Galloway et al.
6,368,234 B1 4/2002 Galloway
6,386,990 B1 5/2002 Reyes et al.
6,398,666 B1 6/2002 Evans et al.
6,435,980 B1 * 8/2002 Reyes et al. ..... 473/324
6,440,011 B1 8/2002 Hocknell et al.
6,471,604 B2 * 10/2002 Hocknell et al. ..... 473/334
6,491,592 B2 * 12/2002 Cackett et al. ..... 473/342
6,565,452 B2 * 5/2003 Helmstetter et al. ..... 473/342
6,582,323 B2 * 6/2003 Soracco et al. ..... 473/342
6,592,466 B2 * 7/2003 Helmstetter et al. ..... 473/224
6,607,623 B2 * 8/2003 Murphy et al. ..... 156/156
6,612,938 B2 * 9/2003 Murphy et al. ..... 473/324
6,676,536 B1 * 1/2004 Jacobson ..... 473/329
2002/0045491 A1 * 4/2002 Reyes et al. ..... 473/345
2003/0171160 A1 * 9/2003 Murphy et al. ..... 473/342
2004/0014534 A1 * 1/2004 Hocknell et al. ..... 473/349

* cited by examiner

GOLF CLUB HEAD

CROSS REFERENCE TO RELATED APPLICATIONS

[Not Applicable]

Federal Research Statement

[Not Applicable]

BACKGROUND OF INVENTION

1. Field of the Invention

The present invention relates to a golf club head with a frame member attached to the body. More specifically, the present invention relates to a golf club head having a body with a large radius transition from a front wall to a crown and a frame member attached to the body.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inch), as opposed to the small deformations of the metallic club face (0.025 to 0.050 inch). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Aizawa, U.S. Pat. No. 5,346,216 for a Golf Club Head, discloses a face plate having a curved ball hitting surface.

U.S. Pat. No. 6,146,571 to Vincent, et.al., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element preferably being between 2.5 and 5 mm in thickness.

U.S. Pat. No. 5,425,538 to Vincent, et al., discloses a hollow golf club head having a steel shell and a composite striking surface composed of a number of stacked woven webs of fiber.

U.S. Pat. No. 5,377,986 to Viollaz, et al., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 and 15 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al. discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight being preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e which measures club face COR. This USGA test procedure, as well as procedures like it, may be used to measure club face COR.

Although the prior art has disclosed many variations of multiple material club heads, the prior art has failed to address the joining of golf club head components to optimize performance.

SUMMARY OF INVENTION

The present invention is directed at golf club head that has a frame member that is attached to a body that has a transition from a front wall to a crown with a radius of curvature of at least 0.250 inch. The frame member is also preferably weighted to move the center of gravity forward toward the front wall of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
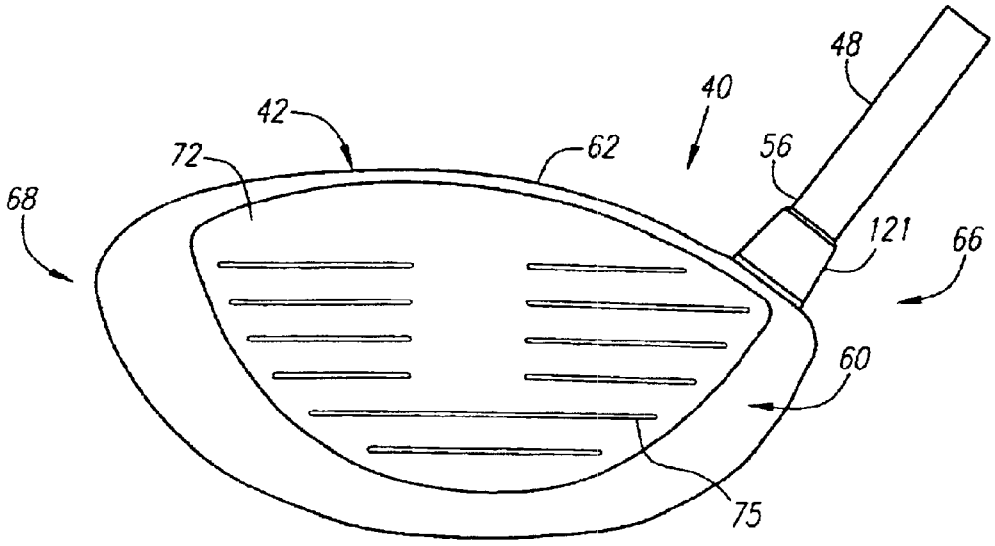
FIG. 1 is a front view of a golf club.

As shown in FIGS. 1–5, a golf club is generally designated 40. The golf club 40 has a golf club head 42 with a hollow interior, not shown. Engaging the club head 42 is a shaft 48 that has a grip, not shown, at a butt end, not shown, and is inserted into a hosel, not shown, at a tip end 56.

The club head 42 is generally composed of two components, a frame member 60, and an body 61. The body 61 has a crown portion 62, a front wall 87 and a sole portion 64. The club head 42 may also be partitioned into a heel section 66 nearest the shaft 48, a toe section 68 opposite the heel section 66, and a rear section 70 opposite the frame member 60.

The frame member 60 is generally composed of a low density material. A preferred low-density material is an injectable thermoplastic material such as a polyurethane. Alternative materials include light-weight metal materials such as magnesium, aluminum, or alloys thereof.

FIGS. 9–13 illustrate a preferred embodiment of the frame member 60. The frame member 60 generally includes a front portion 72 and a return portion 74 extending laterally inward from the perimeter of the front portion 72. The front portion 72 has an opening 83 for exposing a front wall 87 of the body 61.

In a preferred embodiment, the return portion 74 generally includes an upper lateral section 76, a lower lateral section 78, a heel lateral section 80 and a toe lateral section 82. Thus, the return 74 preferably encircles the front portion 72 a full 360 degrees. However, those skilled in the pertinent art will recognize that the return portion 74 may only encompass a partial section of the front portion 72, such as 270 degrees or 180 degrees, and may also be discontinuous.

Figure 5:
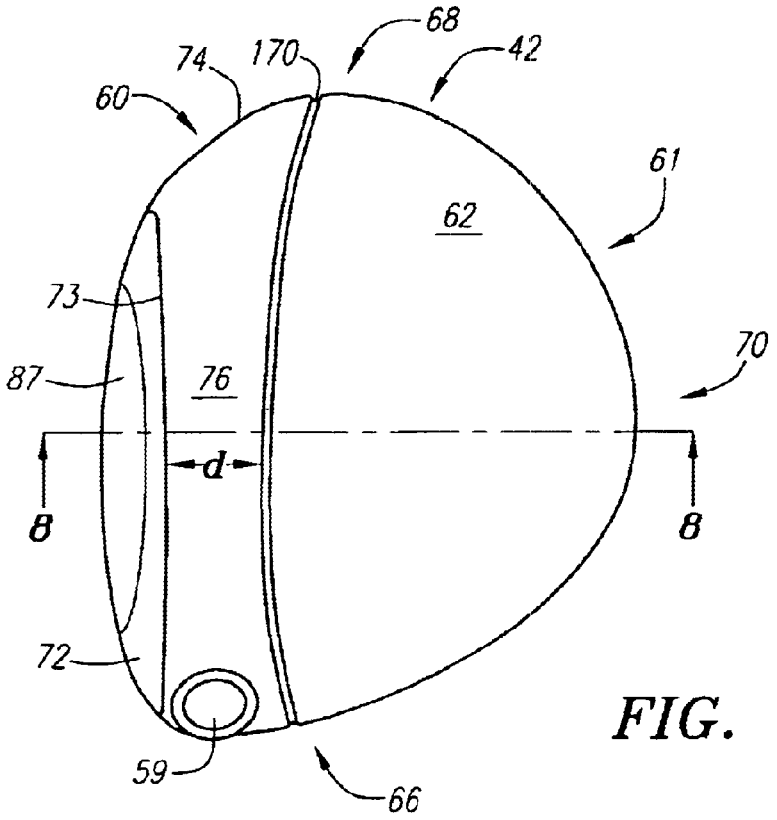
FIG. 5 is a top plan view of the golf club head of FIG. 1.

As shown in FIG. 5, the upper lateral section 76 extends rearward, towards the body 61, a predetermined distance, d, to engage the crown 62. In a preferred embodiment, the predetermined distance ranges from 0.2 inch to 1.0 inch, more preferably 0.40 inch to 0.75 inch, and most preferably 0.68 inch, as measured from the perimeter 73 of the front portion 72 to the rearward edge of the upper lateral section 76. In a preferred embodiment, the upper lateral section 76 has a general curvature from the heel section 66 to the toe section 68. The upper lateral section 76 has a length from the perimeter 73 of the striking plate section 72 that is preferably a minimal length near the center of the front portion 72, and increases toward the toe section 68 and the heel section 66.

The frame member 60 engages the crown 62 along a substantially horizontal plane. In one embodiment, the crown 62 has a crown undercut portion 62*a*, and the return portion 74 of the frame member 60 is placed over the crown undercut portion 62*a*. The crown 62 and the upper lateral section 76 are attached to each other as further explained below.

Figure 4:
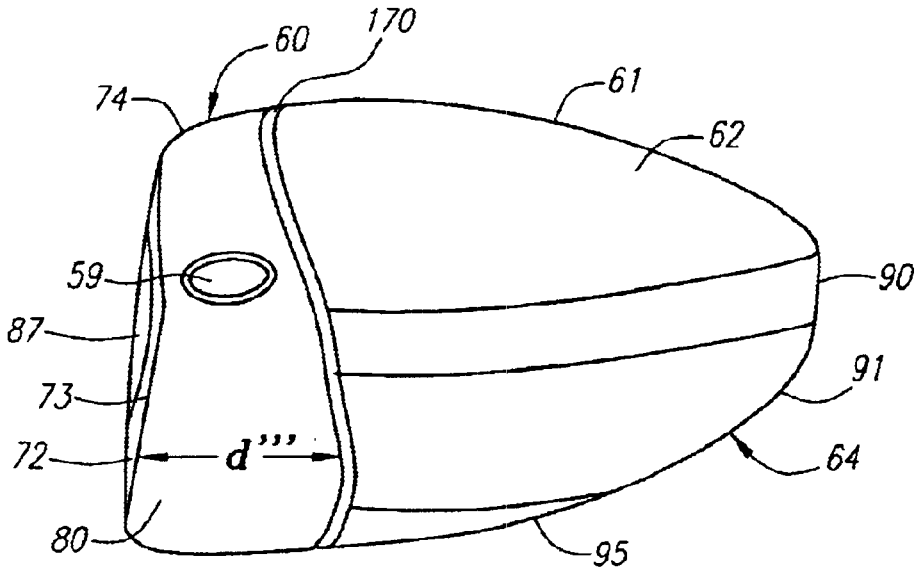
FIG. 4 is a heel side plan view of the golf club head of FIG. 1.

The heel lateral section 80 is substantially perpendicular to the front portion 72, and the heel lateral section 80 covers the hosel 54 before engaging an optional ribbon section 90 and a bottom section 91 of the sole portion 64 of the body 61. The heel lateral section 80 is attached to the sole 64, both the ribbon 90 and the bottom section 91, as explained in greater detail below. As shown in FIG. 4, the heel lateral section 80 extends rearward a distance, d'", from the perimeter 73 a distance of 0.250 inch to 1.50 inches, more preferably 0.50 inch to 1.0 inch, and most preferably 0.950 inch. The heel lateral section 80 preferably has a general curvature at its edge.

Figure 3:
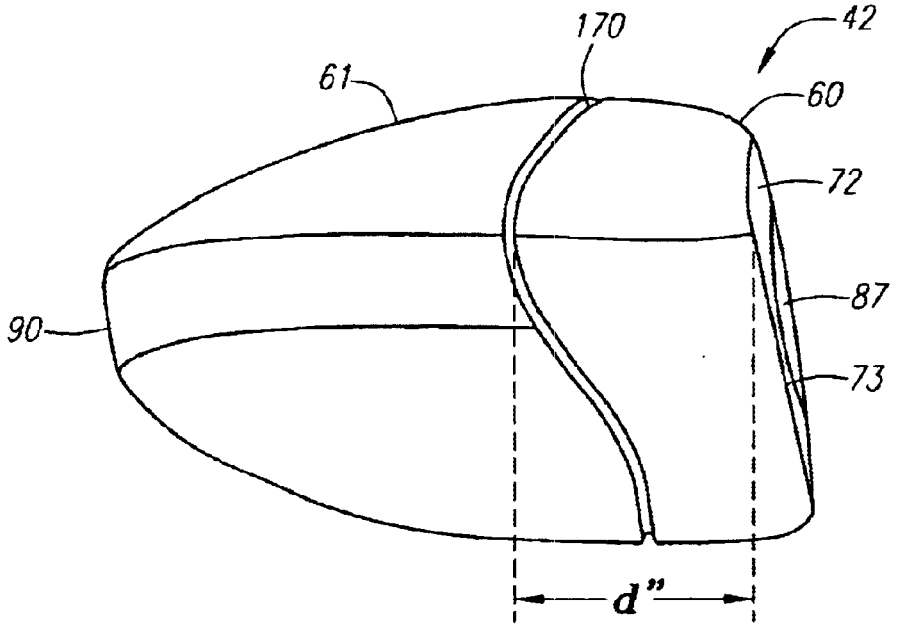
FIG. 3 is toe side view of the golf club head of FIG. 1.

At the other end of the frame member 60 is the toe lateral section 82. The toe lateral section 82 is attached to the sole 64, both the ribbon 90 and the bottom section 91, as explained in greater detail below. As shown in FIG. 3, the toe lateral section 82 extends rearward a distance, d", from the perimeter 73 a distance of 0.250 inch to 1.50 inches, more preferably 0.75 inch to 1.30 inch, and most preferably 1.20 inch. The toe lateral section 80 preferably has a general curvature at its edge.

Figure 6:
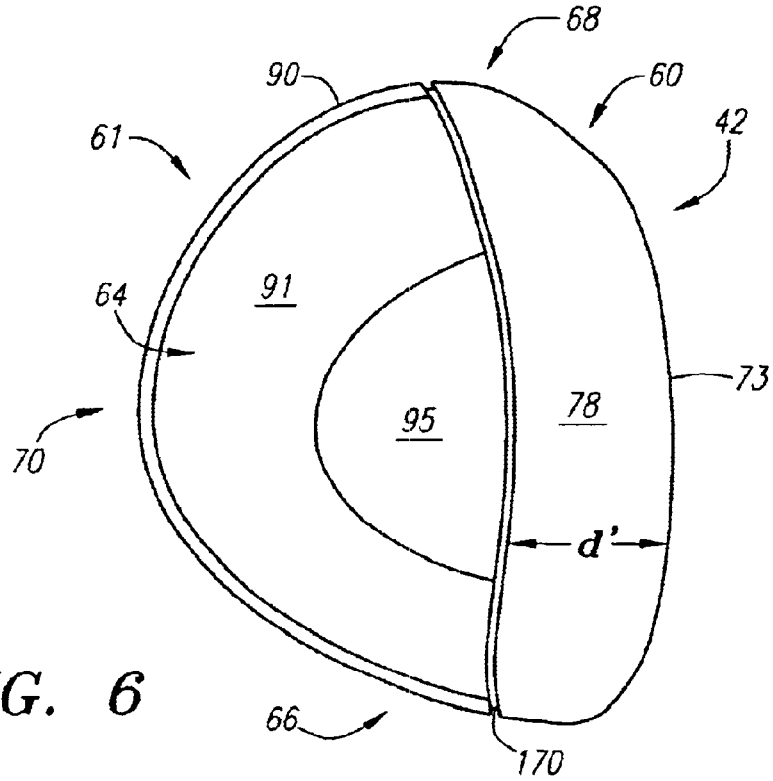
FIG. 6 is a bottom view of the golf club head of FIG. 1.

As shown in FIG. 6, the lower lateral section 78 extends rearward, toward the body 61, a predetermined distance, d', to engage the sole 64. In a preferred embodiment, the predetermined distance ranges from 0.2 inch to 1.25 inches, more preferably 0.50 inch to 1.10 inch, and most preferably 0.9 inch, as measured from the perimeter 73 of the front portion 72 to the edge of the lower lateral section 78. In a preferred embodiment, the lower lateral section 78 has a general curvature from the heel section 66 to the toe section 68. The lower lateral section 78 has a length from the perimeter 73 of the striking plate section 72 that is preferably a minimal length near the center of the striking plate section 72, and increases toward the toe section 68 and the heel section 66.

In one embodiment, the sole portion 64 has a sole undercut portion 64*a*, and the return portion 74 of the frame member is placed over the sole undercut portion 64*a*. The sole 64 is attached to the lower lateral section 78, the heel lateral section 80 and the toe lateral section 82 as explained in greater detail below.

The body 61 is preferably composed of a non-metal material, preferably a composite material such as continuous fiber pre-preg material (including thermosetting materials or a thermoplastic materials for the resin). Other materials for the body 61 include other thermosetting materials or other thermoplastic materials such as injectable plastics. Additionally, in an alternative embodiment, the body 61 is composed of a metal material that includes pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the body 61 include stainless steel, other high strength steel alloy metals and amorphous metals. Further, the body 61 may be manufactured through casting, forming, machining, powdered metal forming, metal-injection-molding, electro chemical milling, and the like.

The body 61, if composed of plies of pre-preg, is preferably manufactured through bladder-molding, resin transfer molding, resin infusion, injection molding, compression molding, or a similar process. In a preferred process, the frame member 60, with an adhesive on the interior surface of the return portion 74, is placed within a mold with a preform of the body 61 for bladder molding. The return portion 74 is placed and fitted into the undercut portions 62*a* and 64*a*. Also, the adhesive may be placed on the undercut portions 62*a* and 64*a*. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

A bladder is placed within the hollow interior of the preform and frame member 60, and is pressurized within the mold, which is also subject to heating. The co-molding process secures the body 61 to the frame member 60. Alternatively, the body 61 is bonded to the frame member 60 using an adhesive, or mechanically secured to the return portion 74. Yet, in a further alternative attachment method, the frame member 60 is press fitted onto the body 61.

Figure 8:
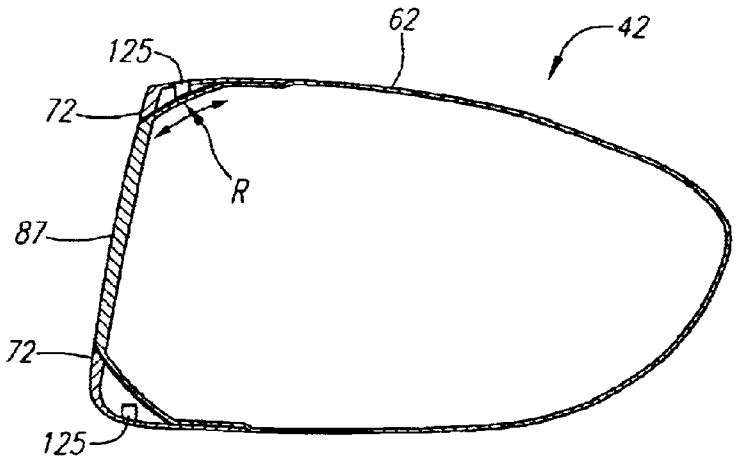
FIG. 8 is a cross-sectional view along line 8—8 of FIG. 5.
Figure 16:
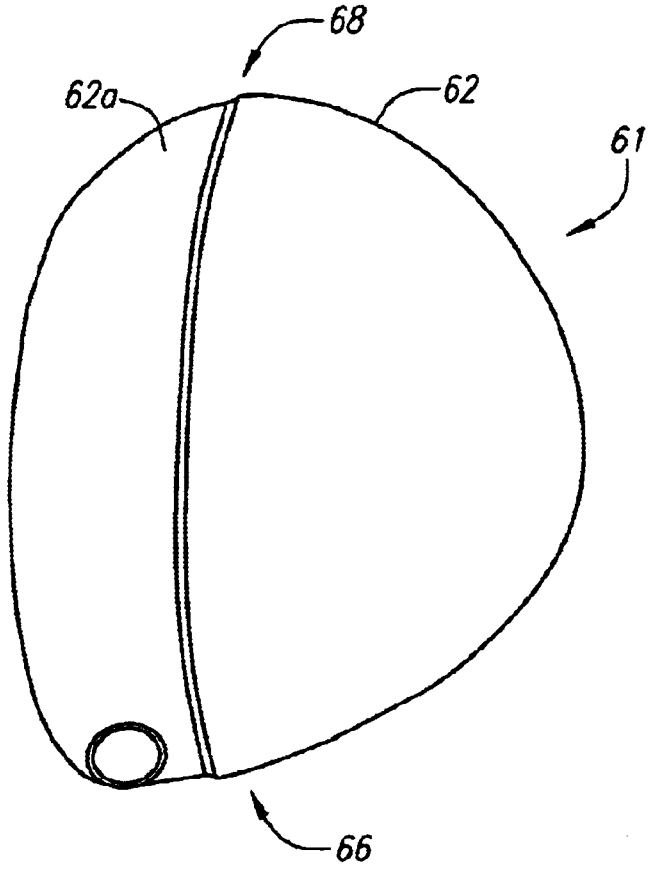
FIG. 16 is a top plan view of the body.
Figure 14:
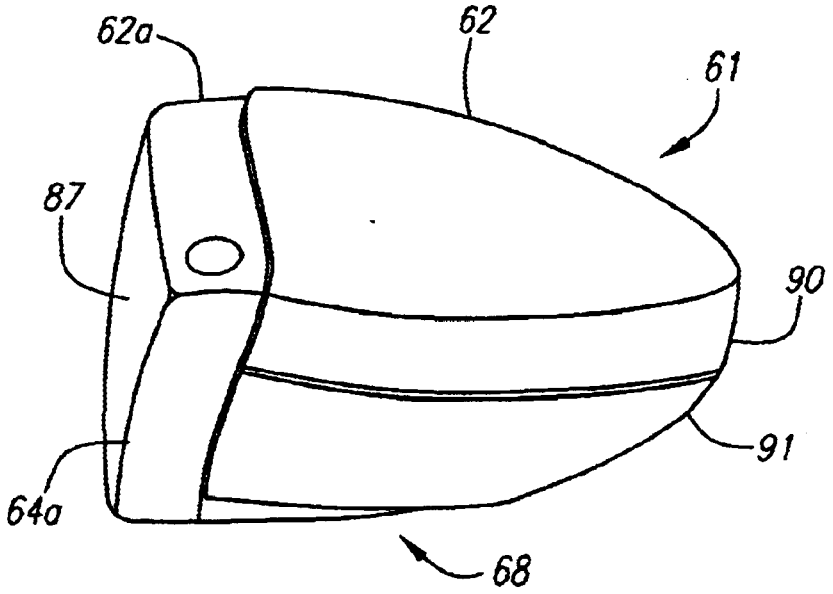
FIG. 14 is an isolated heel-side view of the body.
Figure 15:
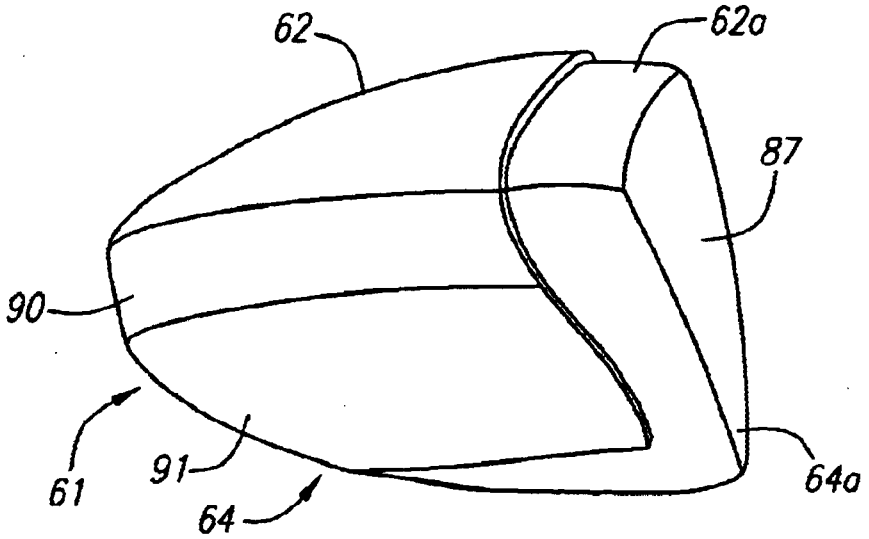
FIG. 15 is a toe side view of the body.

FIGS. 14–16 illustrate a preferred embodiment of the body 61. The crown portion 62 of the aft-body 61 is generally convex toward the sole 64, and engages the ribbon 90 of sole 64 outside of the engagement with the face member 60. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The sole portion 64, including the bottom section 91 and the optional ribbon 90 which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. A front wall 87 is of the body 61 preferably has a thickness ranging from 0.050 inch to 0.300 inch, more preferably from 0.060 inch to 0.125 inch, and most preferably from 0.080 inch to 0.105 inch. The under cut portions 62*a* and 64*a* engage the front wall 87. The radius of curvature R, as shown in FIG. 8, of the transition from the front wall 87 to the crown 62 is preferably at least 0.250 inch, more preferably 0.250 inch to 2.00 inches, and even more preferably 0.250 inch to 1.00 inch. The larger radius of curvature of the transition from the front wall 87 to the crown 62 allows for a stronger, more durable and better performing golf club head 42 since an impact of the front wall 87 with a golf ball is not concentrated at a junction or transition of the front wall 87 and crown 62. The larger radius transition allows for better transmission of the impact load to the crown 62.

In a preferred embodiment, the body 61 is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety. The bottom section 91 is generally convex toward the crown portion 62. The sole portion 64 of the body 61 optionally has a recess 93 for attachment of a sole plate 95 thereto. The sole plate is preferably attached with a pressure sensitive adhesive such as a polyethylene foam acrylic adhesive sold by the 3M company. The sole plate 95 is preferably composed of a light weight metal such as aluminum, titanium or titanium alloy. Alternatively, the sole plate 95 is composed of a durable plastic material. The sole plate 95 may have graphics thereon for designation of the brand of club and loft.

Figure 7:
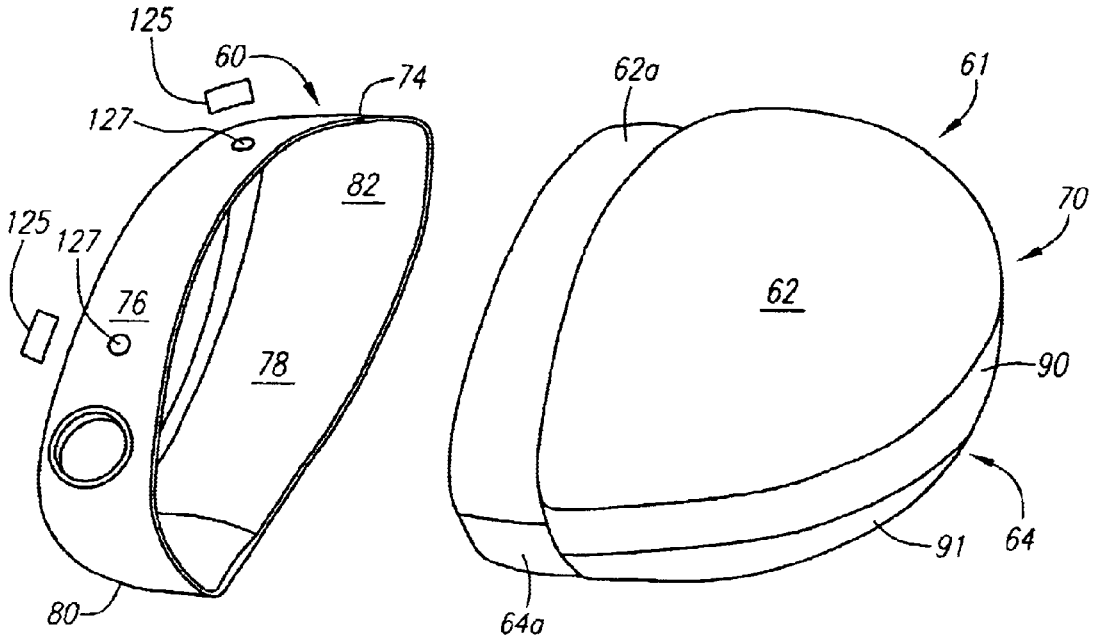
FIG. 7 is an exploded view of a golf club head.

The frame member 60 preferably is weighted to move the overall mass of the golf club head 42 forward. One method of weighting the frame member 60 is to use a plurality of weighting pieces 125 which are disposed within a plurality of weighting ports 127, as shown in FIG. 7. Each of the weighting pieces 125 is preferably a high density material such as tungsten, tungsten loaded film, tungsten doped polymers, or similar weighting mechanisms. A tungsten doped polymer is described in U.S. Pat. Nos. 6,527,659, 09/947,292, entitled Internal Weighting For A Composite Golf Club Head, which relevant parts are hereby incorporated by reference in its entirety. Those skilled in the pertinent art will recognize that other high density materials may be utilized as an optional weighting member without departing from the scope and spirit of the present invention.

Individually, each of the weight pieces 125 has a mass ranging from 2 grams to 20 grams, preferably from 5 grams to 15 grams, and more preferably from 7 grams to 10 grams. Each of the weight pieces 125 preferably has a density ranging from 5 grams per cubic centimeters to 20 grams per cubic centimeters, more preferably from 7 grams per cubic centimeters to 12 grams per cubic centimeters, and most preferably 8.0 grams per cubic centimeters.

Each of the weight pieces 125 is preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyurethane. A preferred weight piece 125 is an injection molded thermoplastic polyurethane integrated with tungsten to have a density of 8.0 grams per cubic centimeters. In a preferred embodiment, each of the weight pieces 125 is composed of from 50 to 95 volume percent polyurethane and from 50 to 5 volume percent tungsten. Also, in a preferred embodiment, each of the weight pieces 125 is composed of from 10 to 25 weight percent polyurethane and from 90 to 75 weight percent tungsten. The weight pieces 125 are positioned about the frame member 60 for biasing the club head, and thus the weight pieces are located in the heel side of the frame member 60 for heel bias of the golf club head 42, and alternatively located in the toe side for toe bias of the golf club head 42.

Figure 11:
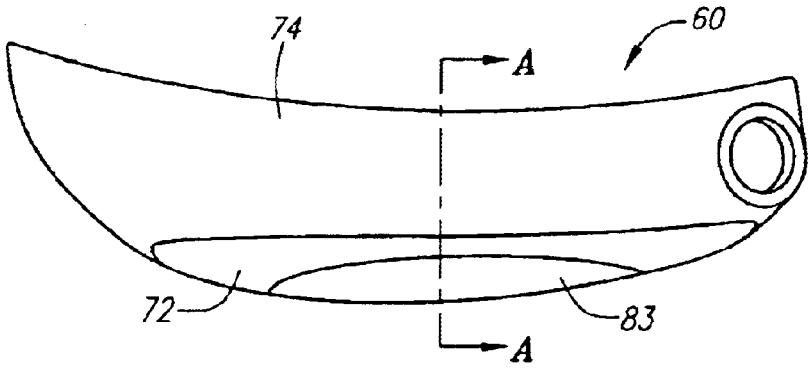
FIG. 11 is a top plan view of the frame member of FIG. 9.
Figure 11A:
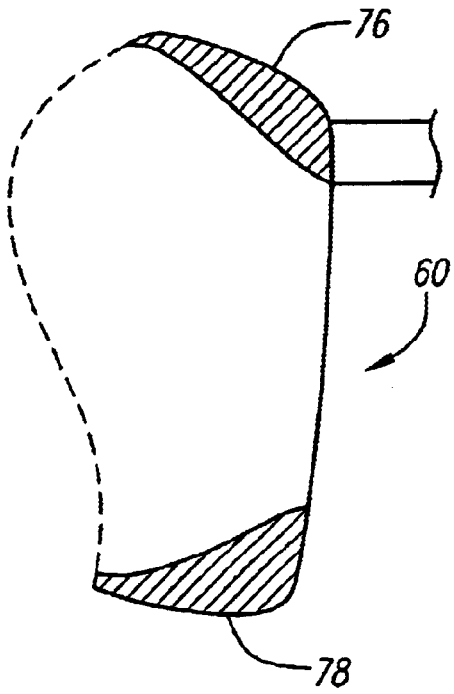
FIG. 11A is a cross-sectional view along line A—A of FIG. 11 of the frame member.

The frame member 60 also creates a more traditional appearance of the golf club head 42, in order to overcome the large radius of curvature of the transition from the front wall 87 to the crown 62. As shown in FIG. 11A, the thickness, "t", of the frame member 60 will vary according to the radius of curvature of transition from the front wall 87 of the body 61 to the crown 62 of the body 61.

Figure 9:
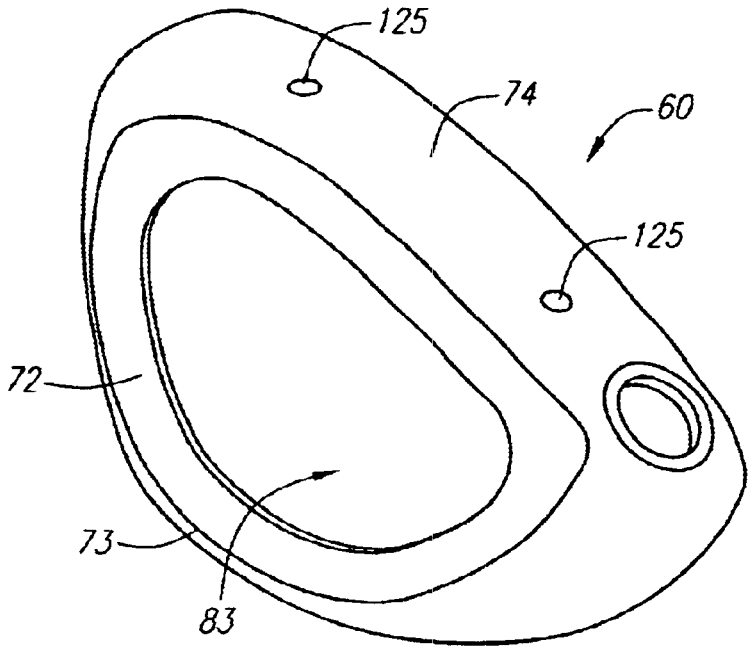
FIG. 9 is an isolated top perspective view of a frame member.
Figure 10:
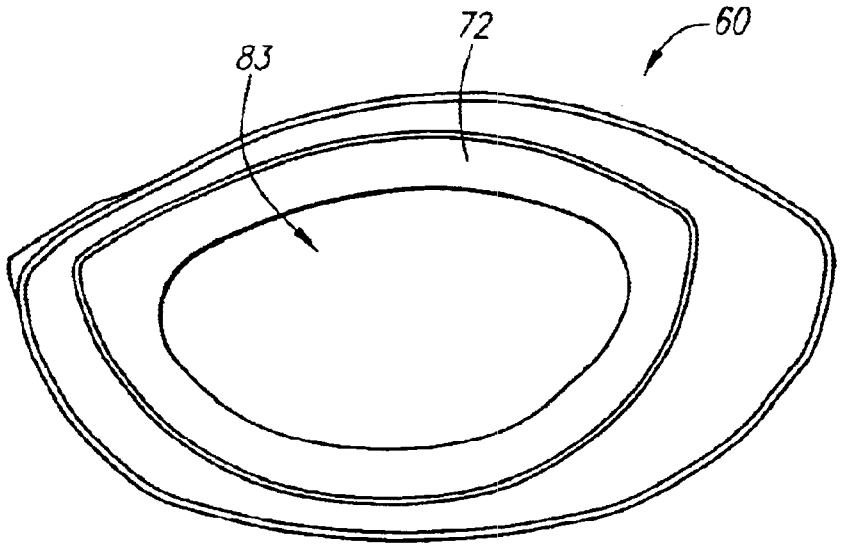
FIG. 10 is an interior view of the frame member of FIG. 9
Figure 12:
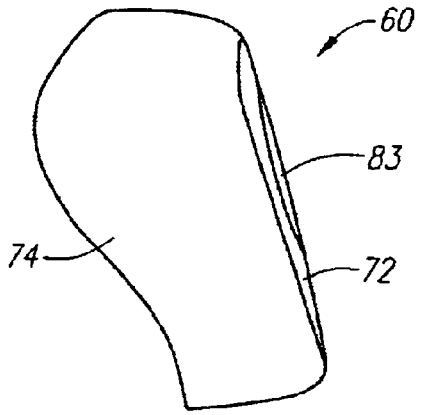
FIG. 12 is a toe side view of the frame member of FIG. 9.
Figure 13:
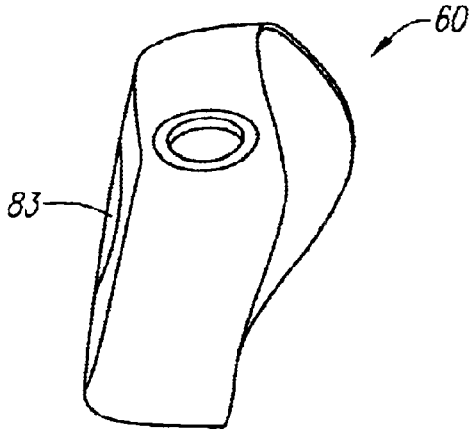
FIG. 13 is a heel side view of the frame member of FIG. 9.

As shown in FIGS. 9 and 10, the front portion 72 of the frame member 60 has an opening 83 to expose the front wall 87 of the body 61. Preferably, the opening 83 has an elliptical shape. Alternatively, the opening 83 has a circular shape. Those skilled within the relevant art will recognize that that opening 83 can have various shapes without departing from the scope and spirit of the present invention. The opening 83 allows for the front wall 87 of the body 61 to absorb the impact during the striking of a golf ball, thus the frame member 60 need not be composed of a material that must withstand the impact during the striking of a golf ball.

As shown in FIG. 8, the return portion 74 overlaps the undercut portions 62*a* and 64*a*. An annular gap 170 is created between an edge 190 of the crown portion 62 and the sole portion 64, and an edge 195 of the return portion 74. The annular gap 170 has a distance Lg that preferably ranges from 0.020 inch to 0.100 inch, more preferably from 0.050 inch to 0.070 inch, and is most preferably 0.060 inch. A bond thickness of the adhesive preferably ranges from 0.002 inch to 0.100 inch, more preferably ranges from 0.005 inch to 0.040 inch, and is most preferably 0.030 inch. A liquid adhesive preferably secures the body 61 to the frame member 60.

The golf club head 42 has a high coefficient of restitution thereby enabling for greater distance of a golf ball hit with the golf club head of the present invention. The coefficient of restitution (also referred to herein as "COR") is determined by the following equation:

$$e = \frac{y_2 - y_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The coefficient of restitution of the club head 42 of the present invention under standard USGA test conditions with a given ball ranges from approximately 0.81 to 0.93, preferably ranges from 0.82 to 0.87 and is most preferably 0.83.

Figure 1A:
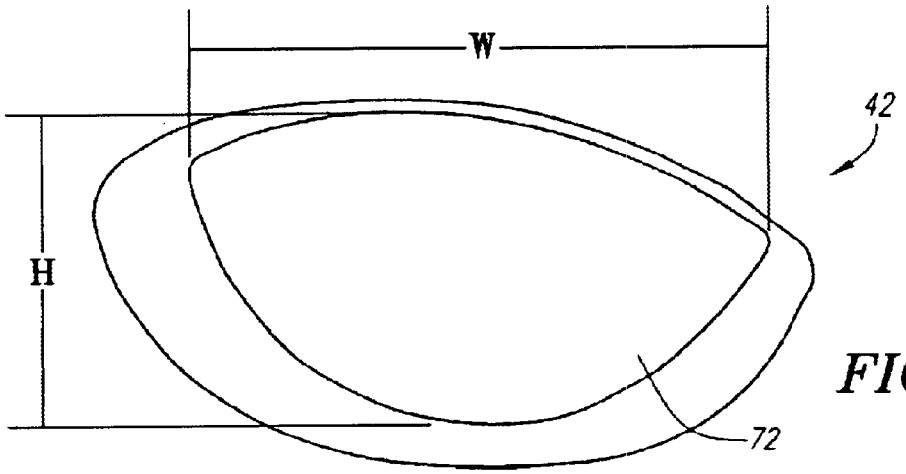
FIG. 1A is a front view of a golf club showing the measurement for the aspect ratio.
Figure 2:
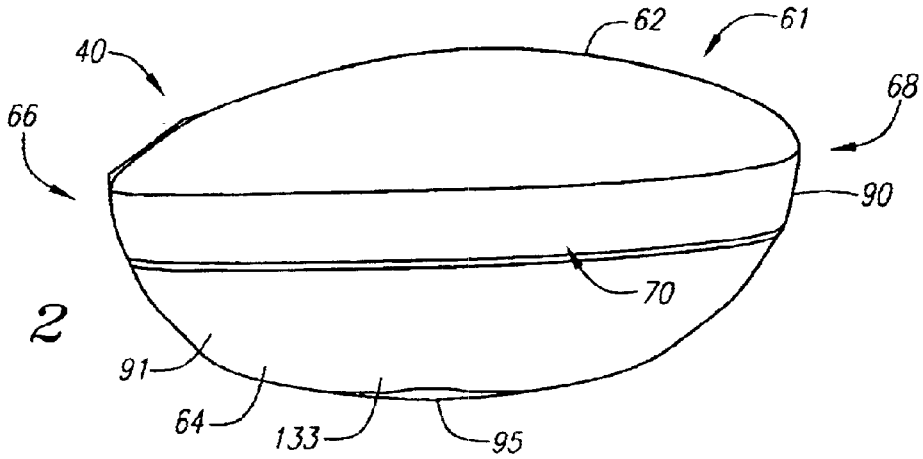
FIG. 2 is a rear view of the golf club head of FIG. 1.

Additionally, the face of the golf club head 42 has a smaller aspect ratio than face plates of the prior art. The aspect ratio as used herein is defined as the width, "w", of the face divided by the height, "h", of the face, as shown in FIG. 1A. In one preferred embodiment, the width w is 78 millimeters and the height h is 48 millimeters giving an aspect ratio of 1.625. In conventional golf club heads, the aspect ratio is usually much greater than 1. For example, the original GREAT BIG BERTHA® driver had an aspect ratio of 1.9. The aspect ratio of the face of the golf club head 42 preferably ranges from 1.0 to 1.7. One embodiment has an aspect ratio of 1.3. The face area of the golf club head 42 ranges from 4.00 square inches to 7.50 square inches, more preferably from 5.00 square inches to 6.5 square inches, and most preferably from 5.8 square inches to 6.0 square inches. The face golf club head 42 is composed of the exposed front wall 87 of the body 61 and the front portion 72 of the frame member 60.

The club head 42 also has a greater volume than a club head of the prior art while maintaining a weight that is substantially equivalent to that of the prior art. The volume of the club head 42 of the present invention ranges from 250 cubic centimeters to 600 cubic centimeters, and more preferably ranges from 350 cubic centimeters to 510 cubic centimeters, even preferably 360 cubic centimeters to 395 cubic centimeters, and most preferably 385 cubic centimeters.

The mass of the club head 42 of the present invention ranges from 165 grams to 225 grams, preferably ranges from 175 grams to 205 grams, and most preferably from 190 grams to 200 grams.

Preferably, the frame member 60 has a mass ranging from 50 grams to 110 grams, more preferably ranging from 65 grams to 95 grams, yet more preferably from 70 grams to 90 grams, and most preferably 78 grams. The body 61 (without weighting) has a mass preferably ranging from 90 grams to 140 grams. The sole plate 95 preferably a mass preferably ranging from 3 grams to 20 grams, more preferably from 5 grams to 15 grams, and most preferably 8 grams. Additionally, epoxy, or other like flowable materials, in an amount ranging from 0.5 grams to 5 grams, may be injected into the hollow interior 46 of the golf club head 42 for selective weighting thereof.

The depth of the club head 42 from the front portion 72 of the frame member 60 to the rear section of the crown portion 62 preferably ranges from 3.0 inches to 4.5 inches, and is most preferably 3.5 inches. The height, "H", of the club head 42, as measured while in striking position, preferably ranges from 2.0 inches to 3.5 inches, and is most preferably 2.50 inches. The width, "W", of the club head 42 from the toe section 68 to the heel section 66 preferably ranges from 4.0 inches to 5.0 inches, and more preferably 4.4 inches.

As defined in *Golf Club Design, Fitting, Alteration & Repair*, $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity of a golf club head may be obtained using a center of gravity table having two weight scales thereon, as disclosed in U.S. Pat. Nos. 6,607,452 09/796,951, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 42 of the present invention will range from 2800 g-cm$^2$ to 5000 g-cm$^2$, preferably from 3000 g-cm$^2$ to 4500 g-cm$^2$, and most preferably from 3750 g-cm$^2$ to 4250 g-cm$^2$. The moment of inertia, Iyy, about the Y axis for the golf club head 42 of the present invention will range from 1500 g-cm$^2$ to 2750 g-cm$^2$, preferably from 2000 g-cm$^2$ to 2400 g-cm$^2$, and most preferably from 2100 g-cm$^2$ to 2300 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

aft-body having a crown, a sole, a front wall, an undercut portion with a leading edge, a transition from the front wall to the crown having a radius of curvature of at least 0.250 inch and a transition from the front wall to the sole having a radius of curvature of at least 0.250 inch, the aft-body composed of a plies of pre-preg material and having a volume ranging from 250 cubic centimeters to 500 cubic centimeters;

a frame member component having a return portion and a front portion, the return portion extending a distance ranging 0.25 inch to 1.5 inches from a perimeter of the front portion, the front portion having an opening, the frame member composed of a thermoplastic polyurethane material with a plurality of weighting pieces disposed within a plurality of weighting ports, the return portion of the frame member attached to the aft-body over the undercut portion and extending to the leading edge, the opening of the front portion of the frame member exposing the front wall of the aft-body.

2. The golf club head according to claim 1 wherein the opening of the front portion is elliptical is shape and a portion of the front wall of the aft-body is exposed for ball striking.

3. The golf club head according to claim 1 wherein the opening of the front portion is circular in shape and a portion of the front wall of the aft-body is exposed for ball striking.

4. The golf club head according to claim 1 wherein the front wall of the aft-body has a thickness ranging from 0.050 inch to 0.300 inch.

5. The golf club head according to claim 1 wherein the frame member has a mass ranging from 10 grams to 100 grams.

6. The golf club head according to claim 5 wherein each of the plurality of weighting pieces is composed of a high density material selected from the group consisting of tungsten and tungsten alloys.

7. A golf club head comprising:

an aft-body having a crown, a sole, a front wall, an undercut portion with a leading edge, a transition from the front wall to the crown having a radius of curvature of at least 0.250 inch and a transition from the front wall to the sole having a radius of curvature of at least 0.250 inch, the aft-body composed of a metal material and having a volume ranging from 250 cubic centimeters to 500 cubic centimeters;

a frame member component having a return portion and a front portion, the return portion extending a distance ranging 0.25 inch to 1.5 inches from a perimeter of the front portion, the front portion having an opening, the return portion of the frame member attached to the body over the undercut portion and extending to the leading edge, the opening of the front portion of the frame member exposing the front wall of the aft-body.

8. The golf club head according to claim 7 wherein the opening of the front portion of the frame member is elliptical in shape and a portion of the front wall of the aft-body is exposed for ball striking.

9. The golf club head according to claim 7 wherein the aft-body is composed of a material selected from the group consisting of titanium alloys, stainless steel, maraging steel, titanium and other steel alloys.

10. The golf club head according to claim 7 wherein the frame member is composed of a material selected from the group consisting of thermoplastic materials, thermosetting materials, magnesium tin, aluminium and amorphous metals.

11. A golf club head comprising:

an aft-body having a crown, a sole, a front wall, an undercut portion with a leading edge, a transition from the front wall to the crown having a radius of curvature of at least 0.250 inch and a transition from the front wall to the sole having a radius of curvature of at least 0.250 inch, the aft-body having a volume ranging from 250 cubic centimeters to 500 cubic centimeters;

a frame member having a return portion and a front portion, the front portion having an opening, the return portion extending a distance ranging 0.25 inch to 1.5 inches from a perimeter of the front portion, the return portion of the frame member attached to the aft-body over the undercut portion and extending to the leading edge, the opening of the front portion of the frame member exposing the front wall of the aft-body.

12. The golf club head according to claim 11 wherein the frame member is attached to the aft-body with an adhesive.

13. The golf club head according to claim 11 wherein the frame member is attached to the body through co-molding.

14. The golf club head according to claim 11 wherein the frame member is attached to the aft-body through press-fitting.

15. A golf club head comprising:

an aft-body having a crown, a sole, a front wall, an undercut portion with a leading edge, a transition from the front wall to the crown having a radius of curvature of at least 0.250 inch and a transition from the front wall to the sole having a radius of curvature of at least 0.250 inch, the aft-body having a volume ranging from 250 cubic centimeters to 500 cubic centimeters;

a frame member having a return portion and a front portion, the front portion having an opening, the return portion extending a distance ranging 0.25 inch to 1.5 inches from a perimeter of the front portion, the return portion of the frame member attached to the aft-body over the undercut portion and extending to the leading edge, the opening of the front portion of the frame member exposing the front wall of the aft-body;

wherein the golf club head has a coefficient of restitution ranging from 0.80 to 0.93 under standard USGA conditions.

* * * * *